US005644300A

United States Patent [19]

Lin

[11] Patent Number: 5,644,300

[45] Date of Patent: Jul. 1, 1997

[54] SEISMOSCOPIC DETECTOR

[76] Inventor: Yea-Ling Lin, 58, Ma Yuan West St., Taichung, Taiwan

[21] Appl. No.: 653,424

[22] Filed: May 24, 1996

Related U.S. Application Data

[63] Continuation-in-part of Ser. No. 535,329, Sep. 27, 1995, abandoned.

[51] Int. Cl.[6] ..... G08B 21/00

[52] U.S. Cl. ..... 340/690; 340/540; 340/691; 340/693

[58] Field of Search ..... 340/690, 540, 340/693, 691

[56] References Cited

U.S. PATENT DOCUMENTS 4,949,077 8/1990 Mbuthia ..... 340/691
5,153,567 10/1992 Chimento ..... 340/691
5,418,523 5/1995 Anderson et al. ..... 340/690

*Primary Examiner*—Glen Swann

[57] ABSTRACT

A seismoscopic detector has a front casing, a rear casing, a positioning plate, a cup and a flashlight. An upper opening, a window, a positioning hole and a plurality of threaded holes are on the front casing. The rear casing has four side plates to support a positioning plate. The inner surface of the side plates has lobes with threaded holes. A cell chamber and a buzzer are disposed in the rear casing. The positioning plate has through holes. A slot and an elastic plate are formed on the positioning plate. The slot is covered by a cell cover. An upper clamp plate and a lower clamp plate are at the lower portions of the positioning plate perpendicularly. A recess and two opposite clipping blocks are formed on the upper clamp plate. A spring is disposed between two clipping blocks. A cup is disposed between two clamp plates. An inner flange is on the cup to receive a sound sensor. A steel ball is placed in the cup. A flashlight is disposed on the spring.

1 Claim, 6 Drawing Sheets

SEISMOSCOPIC DETECTOR

The present invention is a continuation-in-part of application Ser. No. 08/535,329, filed Sep. 27, 1995, now abandoned.

BACKGROUND OF THE INVENTION

The present invention relates to a seismoscopic detector. More particularly, the present invention relates to a seismoscopic detector with an alarm and a flashlight.

The earthquake may occur while people are sleeping. The electric power system may be damaged in an earthquake. People may not be able to find a flashlight, if an earthquake occurs at night. It is necessary to prepare an earthquake alarm with a flashlight which can be used conveniently while an earthquake occurs at night.

SUMMARY OF THE INVENTION

An object of the present invention is to provide a seismoscopic detector with an alarm and a flashlight which can be used conveniently while an earthquake occurs.

Accordingly, a seismoscopic detector comprises a front casing, a rear casing having a shape corresponding to a shape of the front casing, an upper opening formed on the front casing, an undulate upper edge formed on the front casing, a positioning hole formed on an upper portion of the front casing adjacent to the undulate upper edge, a window formed on a center of a front surface of the front casing, a plurality of threaded holes formed on the front casing, the rear casing having four side plates to support a positioning plate, an inner surface of each of the side plates having at least one lobe, each of the lobes having a threaded hole matching a corresponding threaded hole of the front casing, a cell chamber and a buzzer disposed in the rear casing, an upper plate extending from the rear casing, the positioning plate having a plurality of through holes matching the corresponding threaded holes of the front casing, a plurality of fasteners passing through the corresponding threaded holes of the rear casing, the corresponding through holes of the positioning plate and the corresponding threaded holes of the front casing, a slot matching the cell chamber and an elastic plate formed on the positioning plate, the slot covered by a cell cover, an upper clamp plate disposed at a lower portion of the positioning plate perpendicularly, a lower clamp plate disposed at a bottom of the positioning plate perpendicularly, a recess formed under the upper clamp plate, two opposite clipping blocks disposed at two opposite side edges of the upper clamp plate, a spring disposed between two clipping blocks, a cup disposed between the upper clamp plate and the lower clamp plate, an inner flange disposed on an upper rim of the cup to receive a sound sensor, a steel ball placed in the cup, and a flashlight disposed on the spring. The steel ball is shaked to bump the cup to produce a sound wave while an earthquake occurs. The sound sensor senses the sound wave to initiate the buzzer.

DETAILED DESCRIPTION OF THE INVENTION

Figure 1:
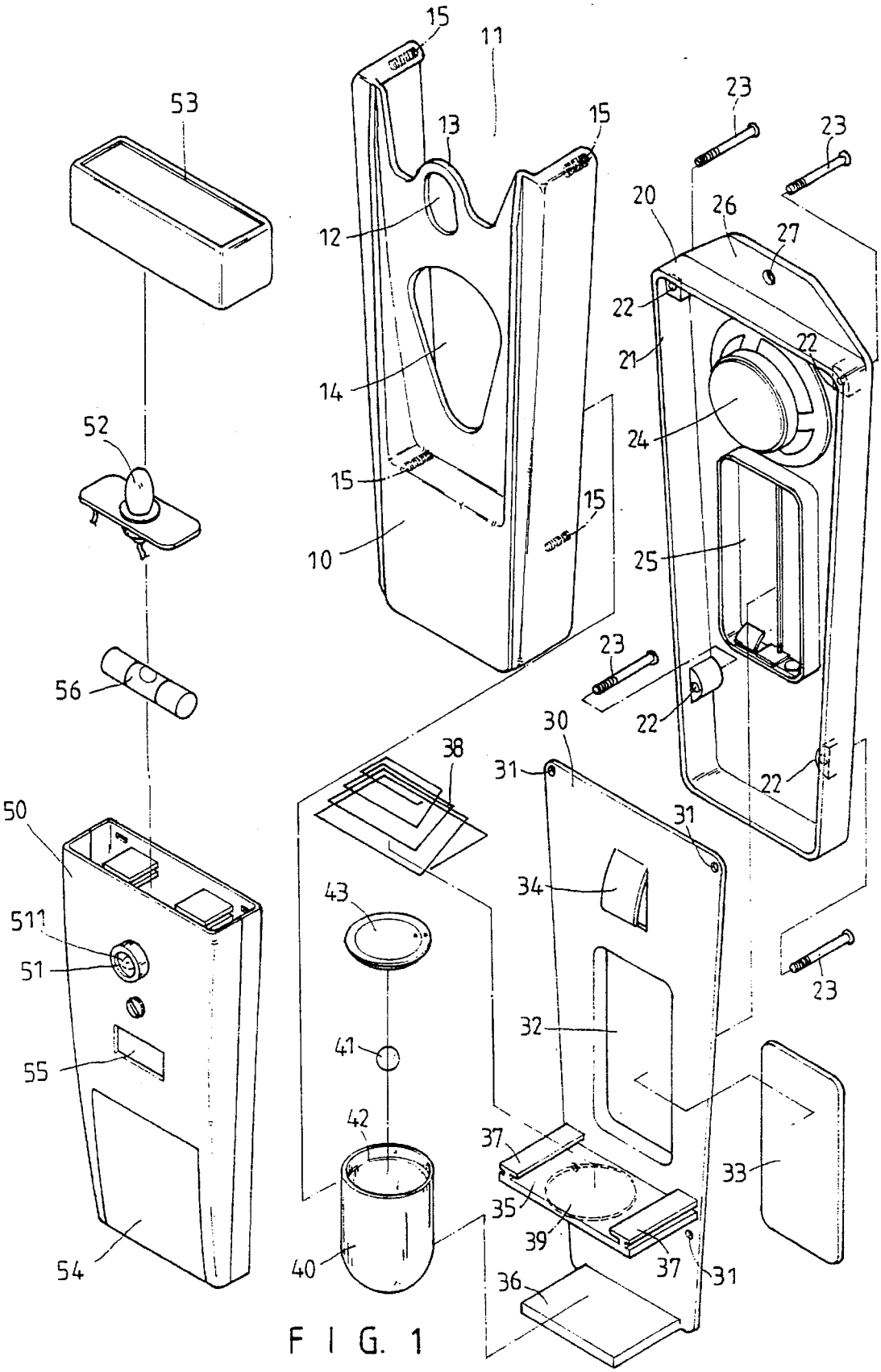
FIG. 1 is a perspective exploded view of a preferred embodiment in accordance with the invention.
Figure 2:
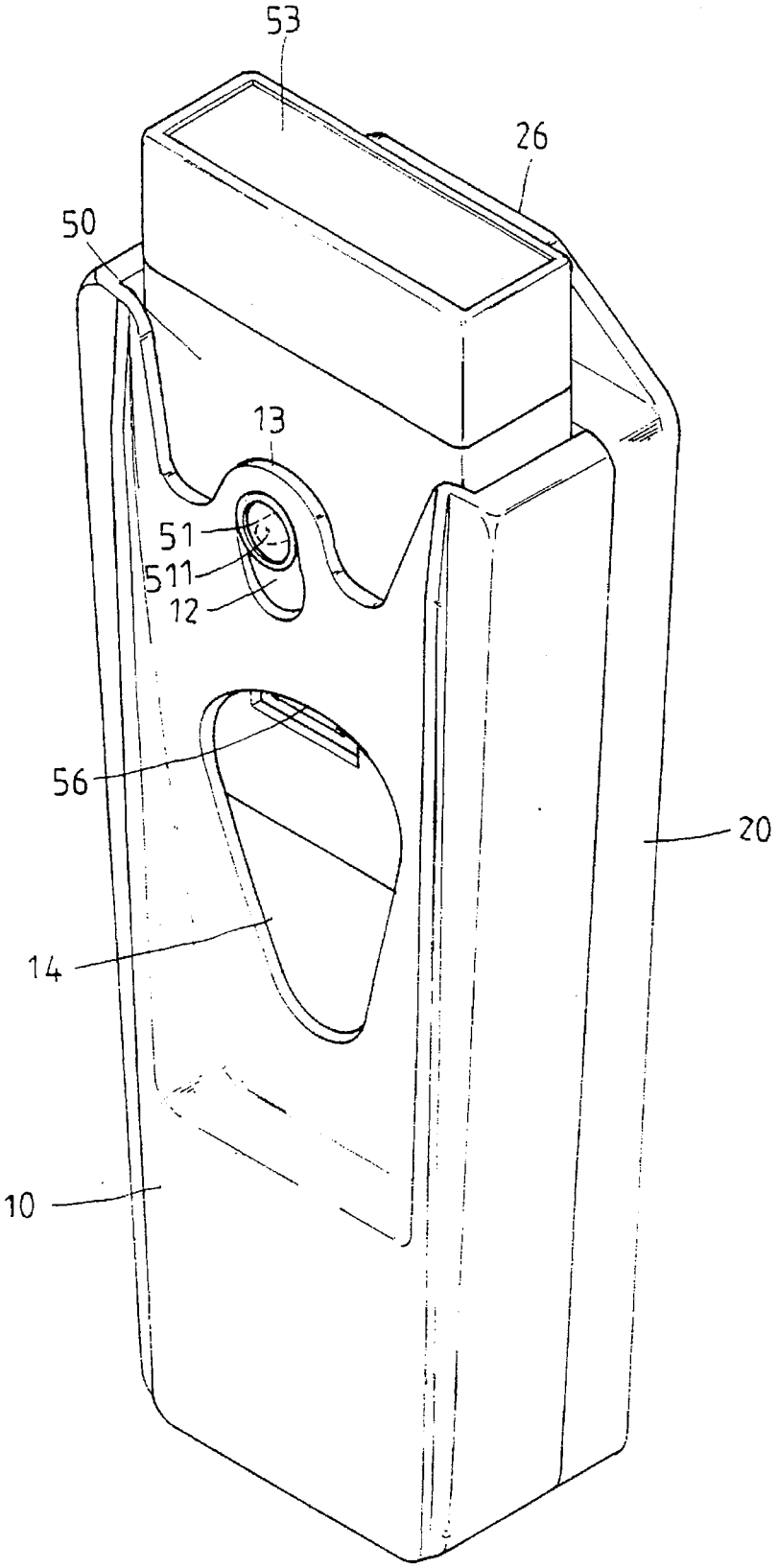
FIG. 2 is a perspective assembly view of FIG. 1.
Figure 3:
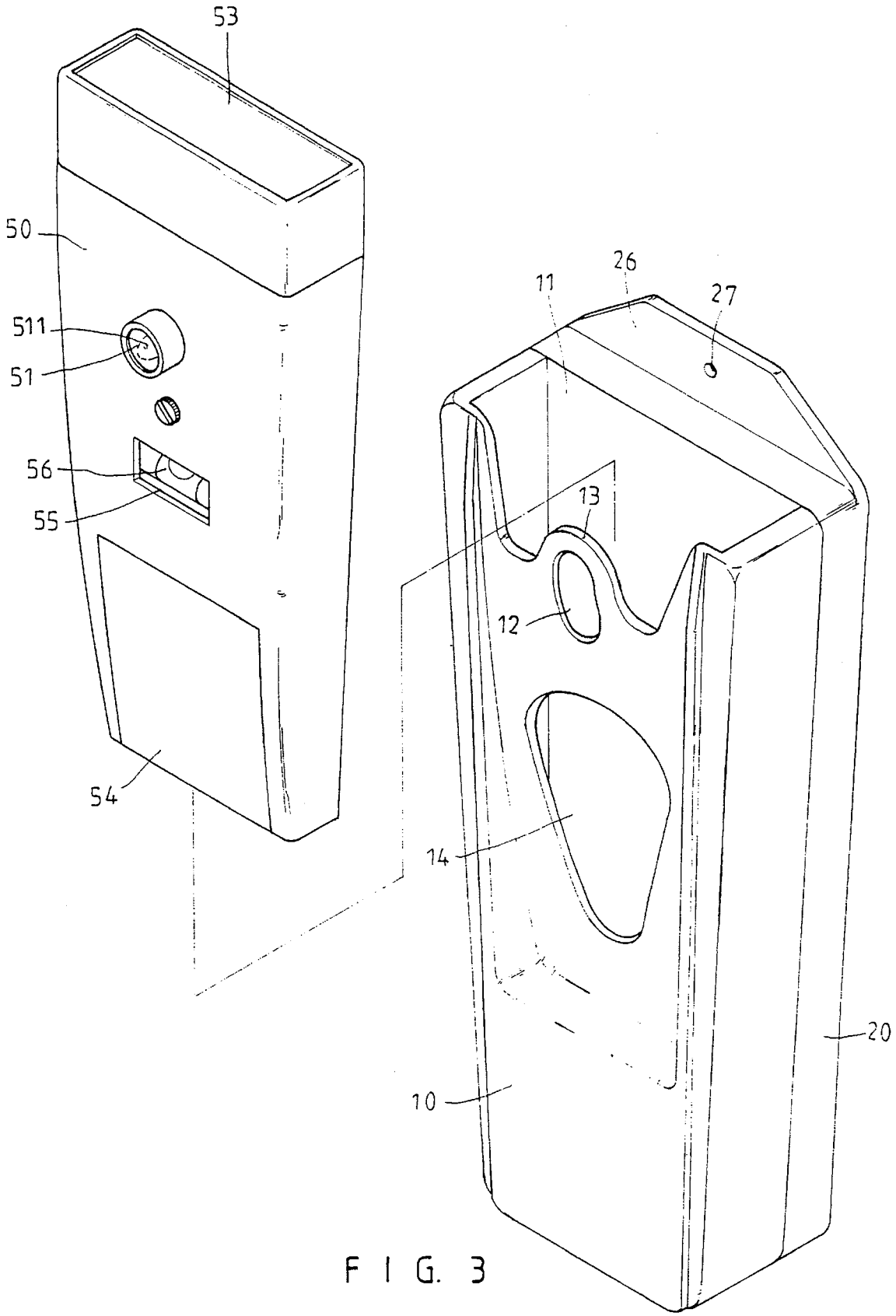
FIG. 3 is a perspective view of FIG. 2 while the flashlight and the seismoscopic detector are separated.

FIG. 1 is a perspective exploded view of a flashlight and a seismoscopic detector. FIG. 2 is a perspective assembly view of the flashlight and the seismoscopic detector. FIG. 3 is a perspective view illustrating the flashlight is taken out of the seismoscopic detector. Referring to FIGS. 1 to 3, a seismoscopic detector has a front casing 10, a rear casing 20, a positioning plate 30, a cup 40 and a flashlight 50.

Figure 6:
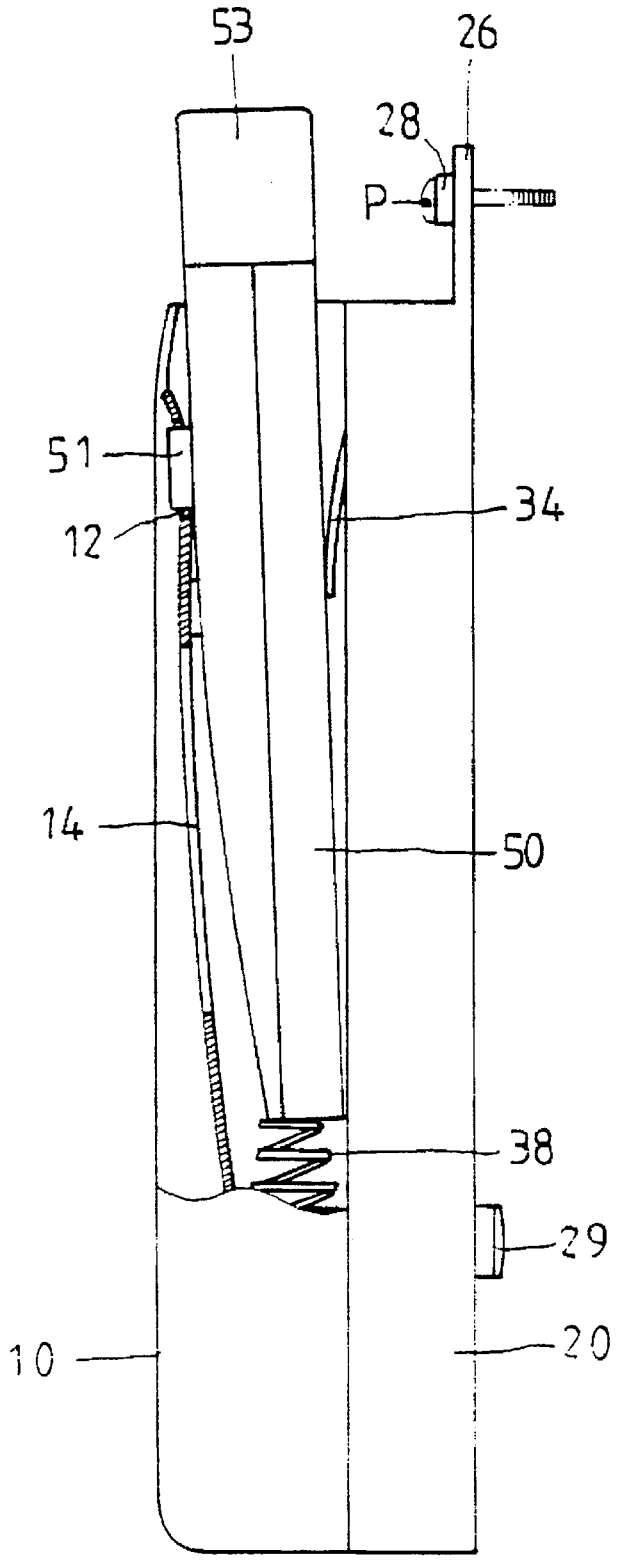
FIG. 6 is a schematic view illustrating the position of the flashlight in the seismoscopic detector.

An upper opening 11 is formed on the front casing 10. An undulate upper edge 13 is formed on the front casing 10. A positioning hole 12 is formed on an upper portion of the front casing 10 adjacent to the undulate upper edge 13. A window 14 is formed on the center of the front surface of the front casing 10. A plurality of threaded holes 15 are formed on the front casing 10. The rear casing 20 has a shape corresponding to the shape of the front casing 10. The rear casing 20 has four side plates 21 to support a positioning plate 30. The inner surface of the side plates 21 has lobes 22. Each lobe 22 has a threaded hole matching the corresponding threaded hole 15 of the front casing 10. A cell chamber 25 and a buzzer 24 are disposed in the rear casing 20. An upper plate 26 extends from the rear casing 20. The upper plate 26 has a hole 27. An anti-slip plate 29 (as shown in FIG. 6) is adhered on the back of the rear casing 20. The positioning plate 30 has a plurality of through holes 31 matching the corresponding threaded hole 15 of the front casing 10. A plurality of screws 23 pass through the corresponding threaded holes of the rear casing 20, the corresponding through holes 31 of the positioning plate 30 and the corresponding threaded holes 15 of the front casing 10. A slot 32 matching the cell chamber 25 and an elastic plate 34 are formed on the positioning plate 30. The slot 32 is covered by a cell cover 33. An upper clamp plate 35 is disposed at the lower portion of the positioning plate 30 perpendicularly. A lower clamp plate 36 is disposed at the bottom of the positioning plate 30 perpendicularly. A recess 39 is formed under the upper clamp plate 35, and two opposite clipping blocks 37 are disposed at two opposite side edges of the upper clamp plate 35. A spring 38 is disposed between two opposite clipping blocks 37. A cup 40 is disposed between the upper clamp plate 35 and the lower clamp plate 36. An inner flange 42 is disposed on the upper rim of the cup 40 to receive a disk-shaped sound sensor 43. A steel ball 41 is placed in the cup 40. A flashlight 50 is disposed on the spring 38. The flashlight 50 has an interior to receive a bubble type level gauge 56 and a bulb 52. A flashlight cover 53 covers the upper opening of the flashlight 50. The positioning device 51 which has an LED (light emitting diode) 511 therein is disposed on the front surface of the flashlight 50. A slip cover 54 and a rectangular hole 55 are formed on the front surface of the flashlight 50. The bubble type level gauge 56 can be seen through the rectangular hole 55. The flashlight 50 is positioned in the front casing 10. The positioning device 51 is inserted in the positioning hole 12. The LED 511 can be seen through the window 14. The seismoscopic detector can be hung on the wall through the hole 27. The bubble type level gauge 56 is used for detecting whether the seismoscopic detector is hung askew.

Referring to FIGS. 1, 2, 3, 5 and 6, the steel ball 41 will be shaked to bump the cup 40 to produce a sound wave while an earthquake occurs. The sound sensor 43 senses the sound wave produced by the steel ball 41 and transforms the sound wave to voice frequency to initiate the buzzer 24 which performs the function as a voice frequency sensor. The LED 511 is initiated by the electric energy.

Figure 4:
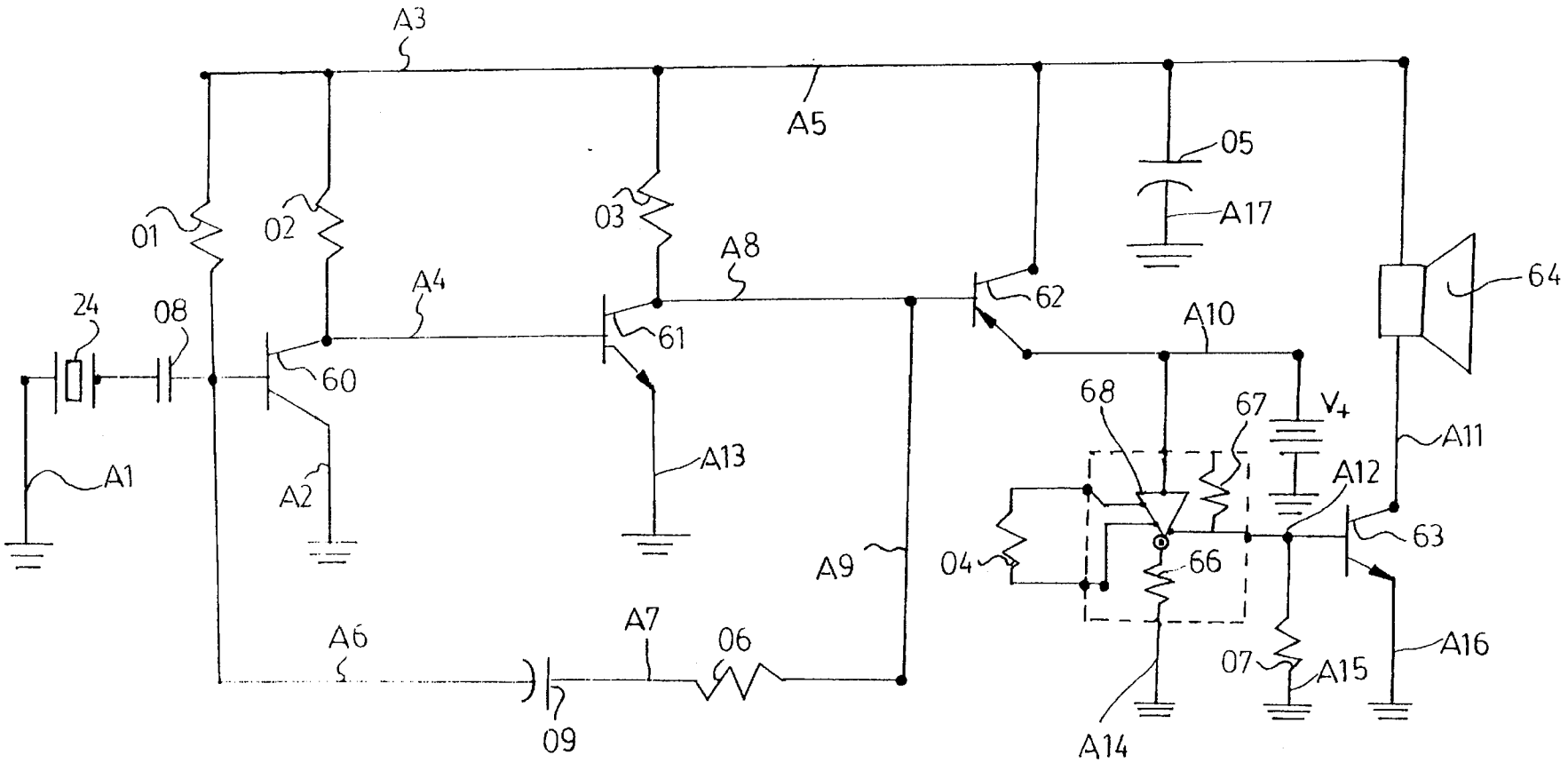
FIG. 4 is a circuit diagram of the present invention.
Figure 5:
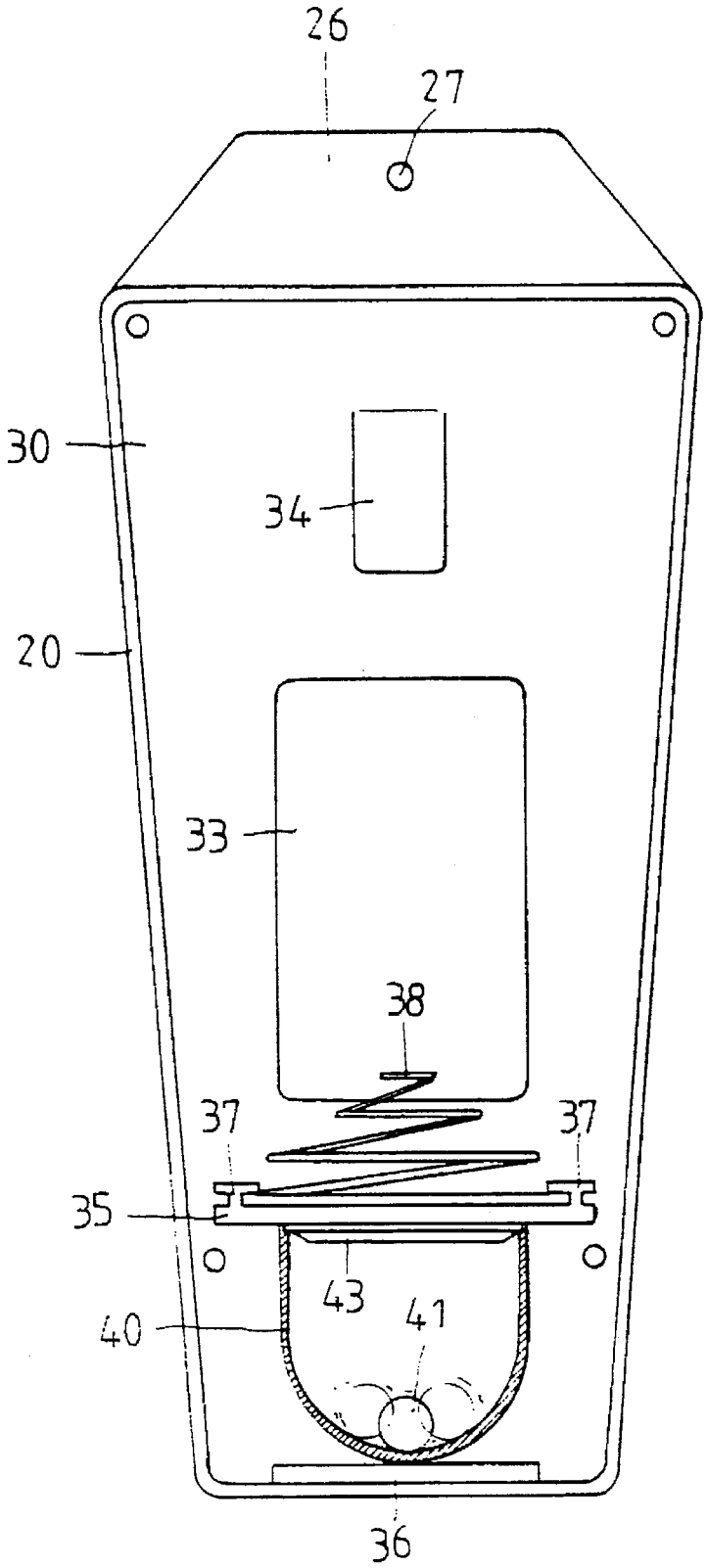
FIG. 5 is a schematic view illustrating an application of the seismoscopic detector while an earthquake occurs.

Referring to FIG. 4, a circuit diagram illustrates the connection of a plurality of electric elements. The electric elements comprise the first, second, third, fourth, fifth, sixth and seventh resistors 01, 02, 03, 04 05, 06 and 07, a condenser 08, an electrolytic capacitor 09, the first, second and third npn transistors 60, 61 and 63, a pnp transistor 62, a speaker 64, a buzzer 24, the first and second internal resistors 66 and 67, and an IC for producing voices 68. The speaker 64 (not shown in the other figures) is disposed under the buzzer 24. All the other electric elements are disposed under the buzzer 24 also. The first, second, thirteen, fourteen, fifteen, sixteen and seventeen circuits A1, A2, A13, A14, A15, A16 and A17 have negative potentials. All the other circuits such as the third, fourth, fifth, sixth, seventh, eighth, ninth, tenth, eleventh and twelfth circuits A3, A4, A5, A6, A7, A8, A9, A10, A11 and A12 have positive potentials. The first and second resistors 01 and 02 which are bias resistors adjust the bias resistivity of the first npn transistor 60. The second and third resistors 02 and 03 which are bias resistors adjust the bias resistivity of the second npn transistor 61. The third resistor 03 adjust the bias resistivity of the pnp transistor 62 also. The transistors 60, 61 and 62 amplify the signals. The transistor 63 amplifies the sound. The speaker 64 outputs the amplified sound. The buzzer 24 and the condenser 08 are in harmonic oscillation. The signal is filtered by the condenser 08 and amplified by the first npn transistor 60. The signal is amplified by the second npn transistor 61 also. The pnp transistor 62 can amplify the signal and trigger on the IC for producing voices 68. The third npn transistor 63 can amplify the voices, and the speaker 64 outputs the voices.

The invention is not limited to the above embodiment but various modification thereof may be made.

I claim:

1. A seismoscopic detector comprising:

a front casing;

a rear casing having a shape corresponding to a shape of said front casing;

an upper opening formed on said front casing;

an undulate upper edge formed on said front casing;

a positioning hole formed on an upper portion of said front casing adjacent to said undulate upper edge;

a window formed on a center of a front surface of said front casing;

a plurality of threaded holes formed on said front casing;

said rear casing having four side plates to support a positioning plate;

an inner surface of each of said side plates having at least one lobe;

each of said lobes having a threaded hole matching a corresponding threaded hole of said front casing;

a cell chamber and a buzzer disposed in said rear casing;

an upper plate extending from said rear casing;

said positioning plate having a plurality of through holes matching said corresponding threaded holes of said front casing;

a plurality of fasteners passing through said corresponding threaded holes of said rear casing, said corresponding through holes of said positioning plate and said corresponding threaded holes of said front casing;

a slot matching said cell chamber and an elastic plate formed on said positioning plate;

said slot covered by a cell cover;

an upper clamp plate disposed at a lower portion of said positioning plate perpendicularly;

a lower clamp plate disposed at a bottom of said positioning plate perpendicularly;

a recess formed under said upper clamp plate;

two opposite clipping blocks disposed at two opposite side edges of said upper clamp plate;

a spring disposed between said two clipping blocks;

a cup disposed between said upper clamp plate and said lower clamp plate;

an inner flange disposed on an upper rim of said cup to receive a sound sensor;

a steel ball placed in said cup;

a flashlight disposed on said spring;

wherein said steel ball is shaked to bump said cup to produce a sound wave while an earthquake occurs, and said sound sensor senses said sound wave to initiate said buzzer.

* * * * *